US010053873B2

(12) United States Patent
Grinwald

(10) Patent No.: US 10,053,873 B2
(45) Date of Patent: Aug. 21, 2018

(54) HANDLE ASSEMBLIES WITH VIBRATION DAMPENING ASSEMBLIES FOR CONCRETE FINISHING MACHINES

(71) Applicant: M-B-W, Inc., Slinger, WI (US)

(72) Inventor: Anthony Grinwald, Rubicon, WI (US)

(73) Assignee: M-B-W, Inc., Slinger, WI (US)

( * ) Notice: Subject to any disclaimer, the term of this patent is extended or adjusted under 35 U.S.C. 154(b) by 0 days.

(21) Appl. No.: 15/492,875

(22) Filed: Apr. 20, 2017

(65) Prior Publication Data

US 2018/0051472 A1 Feb. 22, 2018

Related U.S. Application Data

(60) Provisional application No. 62/376,125, filed on Aug. 17, 2016.

(51) Int. Cl.
*E01C 19/00* (2006.01)
*E04F 21/24* (2006.01)
(Continued)

(52) U.S. Cl.
CPC ..... *E04F 21/248* (2013.01); *B25F 5/006* (2013.01); *E01C 19/42* (2013.01)

(58) Field of Classification Search
CPC ..... E04F 21/248; B25F 5/006; E01C 19/42
(Continued)

(56) References Cited

U.S. PATENT DOCUMENTS 4,232,980 A 11/1980 Tertinek et al.
5,096,330 A 3/1992 Artzberger
(Continued)

FOREIGN PATENT DOCUMENTS

JP 56062026 U 5/1981
JP 2005058080 A 3/2005

OTHER PUBLICATIONS

Rhin-O-Tuff Power Trowels L.L.C., Operation and Parts Manual for Walk-Behind Power Trowels Models RE35, R36, R46, and RXV46, 10336, Apr. 2008.
(Continued)

*Primary Examiner* — Raymond W Addie
(74) *Attorney, Agent, or Firm* — Andrus Intellectual Property Law, LLP

(57) ABSTRACT

A handle assembly for a power tool includes a main handle having a first end configured to couple to the power tool and a handle bar having a first end coupled to the main handle. The handle bar has an isolation bushing positioned at a first vibration dampening point and configured to dampen vibrations transmitted between the main handle and the handle bar. A vibration dampening assembly couples the handle bar to the main handle at a second vibration dampening point and is configured to further dampen vibrations transmitted between the main handle and the handle bar. The vibration dampening assembly includes a collar that encircles the main handle and a pair of annular resilient member positioned between the collar and the main handle. The collar defines a pair of circumferential grooves that receive the annular resilient member, and the resilient members are configured to be compressed into the circumferential grooves such that dampening of vibrations and maneuverability of the power tool varies as the resilient member is compressed.

20 Claims, 8 Drawing Sheets

(51) Int. Cl.
*B25F 5/00* (2006.01)
*E01C 19/42* (2006.01)

(58) Field of Classification Search
USPC ..... 404/112
See application file for complete search history.

(56) References Cited

U.S. PATENT DOCUMENTS

| | | | | |
|---|---|---|---|---|
| 5,993,109 | A | 11/1999 | Motl et al. | |
| 6,267,532 | B1 | 7/2001 | Persson | |
| 6,412,180 | B1 | 7/2002 | Wolf et al. | |
| 7,039,986 | B2 * | 5/2006 | Glenn | B24B 7/186 15/DIG. 10 |
| 7,174,970 | B2 | 2/2007 | Kremer | |
| 7,322,428 | B2 * | 1/2008 | Bacila | B25D 17/043 16/431 |
| 8,491,218 | B2 | 7/2013 | Halvorson et al. | |
| 2006/0207063 | A1 | 9/2006 | Jaszkowiak et al. | |
| 2007/0151074 | A1 | 7/2007 | Whiteman, Jr. et al. | |
| 2008/0289842 | A1 | 11/2008 | Chapple et al. | |

OTHER PUBLICATIONS

Rhin-O-Tuff Power Trowels L.L.C., RhinO-Tuff Power Trowels, Feb. 21, 2017.

Search Report for Great Britain Application GB1708217.3 dated Nov. 24, 2017.

* cited by examiner

HANDLE ASSEMBLIES WITH VIBRATION DAMPENING ASSEMBLIES FOR CONCRETE FINISHING MACHINES

CROSS-REFERENCE TO RELATED APPLICATION

The present application is based on and claims priority to U.S. Provisional Patent Application Ser. No. 62/376,125 filed Aug. 17, 2016, the disclosure of which is incorporated herein by reference.

FIELD

The present disclosure relates to power tool handle assemblies with vibration dampening assemblies.

BACKGROUND

Power tools, such as walk behind power trowels or concrete finishing machines, are used by contactors and construction companies to finish (e.g. smooth, polish) the surface of concrete slabs. An operator maneuvers the power tool by grasping and applying forces to a handle assembly which is coupled to the power tool. During operation of the power tool, vibrations are created by the power tool (e.g. engine or impact vibrations) and transmitted through the handle assembly to the operator.

Attempts have been made to reduce the amount of vibrations transmitted to the operator by providing "low-vibration" handle assemblies with vibration dampening assemblies (e.g. see the disclosure of the below-incorporated U.S. Pat. No. 4,232,980). However, these prior art handle assemblies are ineffective in reducing vibrations transmitted to the operator when compared to the handle assembly of the present disclosure described herein.

The following U.S. patents incorporated herein by reference in its entirety:

U.S. Pat. No. 5,096,330 discloses a pitch control mechanism for surface finishing machines. The machines include a series of tilt-able horizontal blades carried by a rotor and the blades are adapted to rotate in contact with and finish a concrete surface.

U.S. Pat. No. 4,232,980 discloses a rotary power trowel having a safety clutch, a gyroscopic stabilizing ring, blade pitch control, and an adjustable handle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a handle assembly for a power tool includes a main handle having a first end configured to couple to the power tool and a handle bar having a first end coupled to the main handle at a first vibration dampening point and a second end opposite the first end. The handle bar has an isolation bushing positioned at the first vibration dampening point and configured to dampen vibrations transmitted between the main handle and the handle bar. A vibration dampening assembly couples the handle bar to the main handle at a second vibration dampening point and is configured to further dampen vibrations transmitted between the main handle and the handle bar. The vibration dampening assembly includes a collar that encircles the main handle and a resilient member positioned between the collar and the main handle. The resilient member is configured to be compressed between the main handle and the collar such that dampening of vibrations and maneuverability of the power tool varies as the resilient member is compressed In certain examples, a handle assembly for a power tool includes a main handle having a first end configured to couple to the power tool and a handle bar having a first end coupled to the main handle at a first vibration dampening point and a second end opposite the first end. The handle bar has an isolation bushing positioned at the first vibration dampening point and configured to dampen vibrations transmitted between the main handle and the handle bar. A vibration dampening assembly couples the handle bar to the main handle at a second vibration dampening point and is configured to further dampen vibrations transmitted between the main handle and the handle bar. The vibration dampening assembly includes a collar that encircles the main handle and a pair of annular resilient members positioned between the collar and the main handle. The collar has an inner surface that defines a pair of circumferential grooves that receive the resilient members, and the resilient members are configured to be compressed into the circumferential grooves such that dampening of vibrations and maneuverability of the power tool varies as the resilient member is compressed.

In certain examples, a motorized trowel for finishing a surface a guard ring, a motor coupled to the guard ring, a plurality of trowel blades operably coupled to the motor and configured to rotate when the motor is activated, a main handle having a first end configured to couple to the power tool, and a handle bar having a first end coupled to the main handle at a first vibration dampening point and a second end opposite the first end. The handle bar has an isolation bushing positioned at the first vibration dampening point and configured to dampen vibrations transmitted between the main handle and the handle bar. A vibration dampening assembly that couples the handle bar to the main handle at a second vibration dampening point and is configured to further dampen vibrations transmitted between the main handle and the handle bar. The vibration dampening assembly includes a collar that encircles the main handle and a pair of annular resilient member positioned between the collar and the main handle. The collar has an inner surface that defines a pair of circumferential grooves receive the annular resilient members. The resilient members are configured to be compressed into the circumferential grooves such that maneuverability of the power tool improves as the resilient members are compressed.

Various other features, objects, and advantages will be made apparent from the following description taken together with the drawings.

BRIEF DESCRIPTION OF THE DRAWINGS

Examples of the present disclosure are described herein below with reference to the following drawing Figures. The same numbers are used throughout the Figures to reference like features and components.

DETAILED DESCRIPTION

In the present description, certain terms have been used for brevity, clearness, and understanding. No unnecessary limitations are to be implied here from beyond the requirements of the prior art because such terms are used for descriptive purposes only and are intended to be broadly construed. The different apparatuses described herein may be used alone or in combination with other apparatuses. Various equivalents, alternatives, and modifications are possible within the scope of the amended claims.

Through research and experimentation, the present inventor has recognized that power tools, e.g. walk-behind power trowels or concrete finishing machines, create and/or transmit highly variable and often large amounts of broad range vibrations (i.e. different types of vibrations having varying frequencies and/or amplitudes) to an operator of the power tool. Some key factors that produce/create or affect power tool handle vibrations are engine vibrations and rotor speed (both of which are widely variable), flatness of the surface upon which the power tool is operated, the concrete's state of hydration, the integrity of the machine's perpendicular relationships between vertical gearbox shaft and troweling blades, and how the operator is applying pressures/forces to the handle assembly to move or maneuver the power tool side-to-side, forward and backward, or some combination of such movements. As such, effective isolation or dampening of vibrations transmitted to the operator requires a design capable of simultaneously addressing a range of vibration frequencies and amplitudes.

Figure 1:
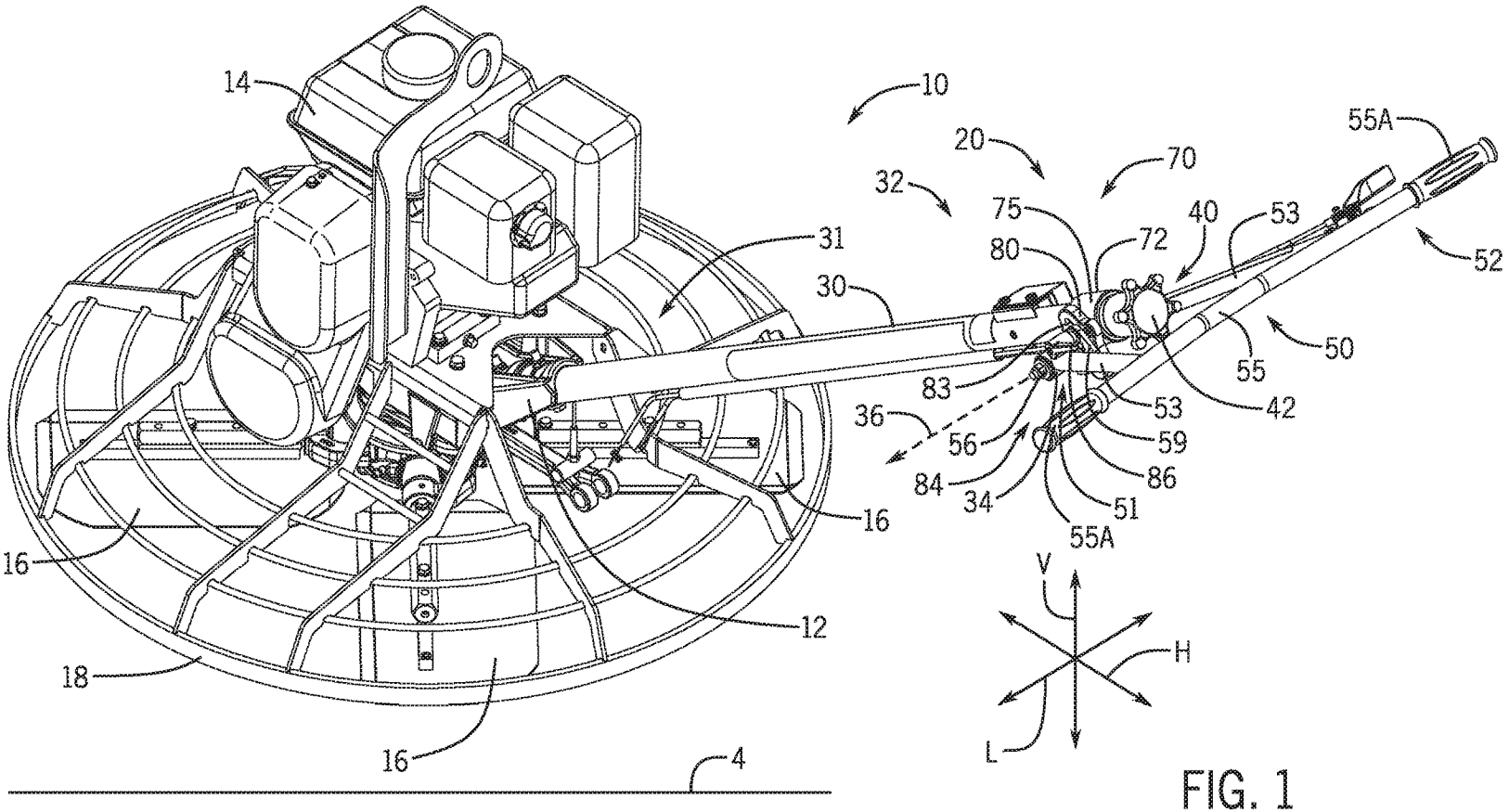
FIG. 1 a perspective view of an example walk-behind power trowel having a handle assembly.

Referring to FIG. 1, a power tool 10 (e.g. walk-behind power trowel) and a handle assembly 20 are depicted. The power tool 10 includes a gearbox 12, an engine 14, a plurality of trowel blades 16, and a guard ring 18. The engine 14 is coupled to the guard ring 18 and is configured to rotate the plurality of trowel blades 16 and thereby finish (e.g. smooth, polish) a surface 4. During operation of the power tool 10, the engine 14 and/or the trowel blades 16 contacting on the surface 4 create vibrations that are transmitted to the handle assembly 20 and ultimately to the operator. The guard ring 18 prevents the operator and/or other equipment from contacting the trowel blades 16. One of ordinary skill in the art will recognize that the handle assembly 20 can be coupled to any type of power tool.

Figure 2:
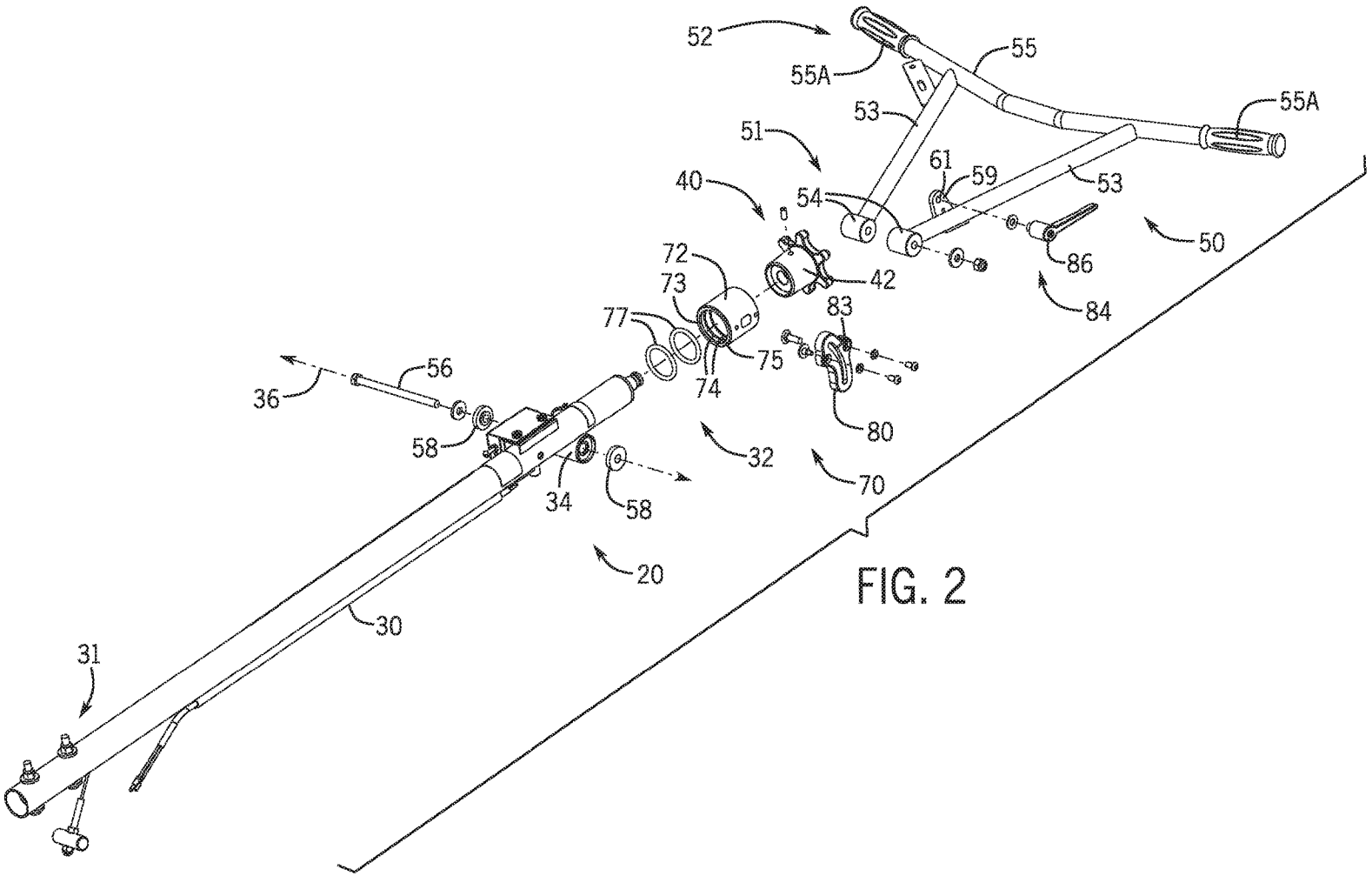
FIG. 2 is an exploded view of the handle assembly of FIG. 1.
Figure 3:
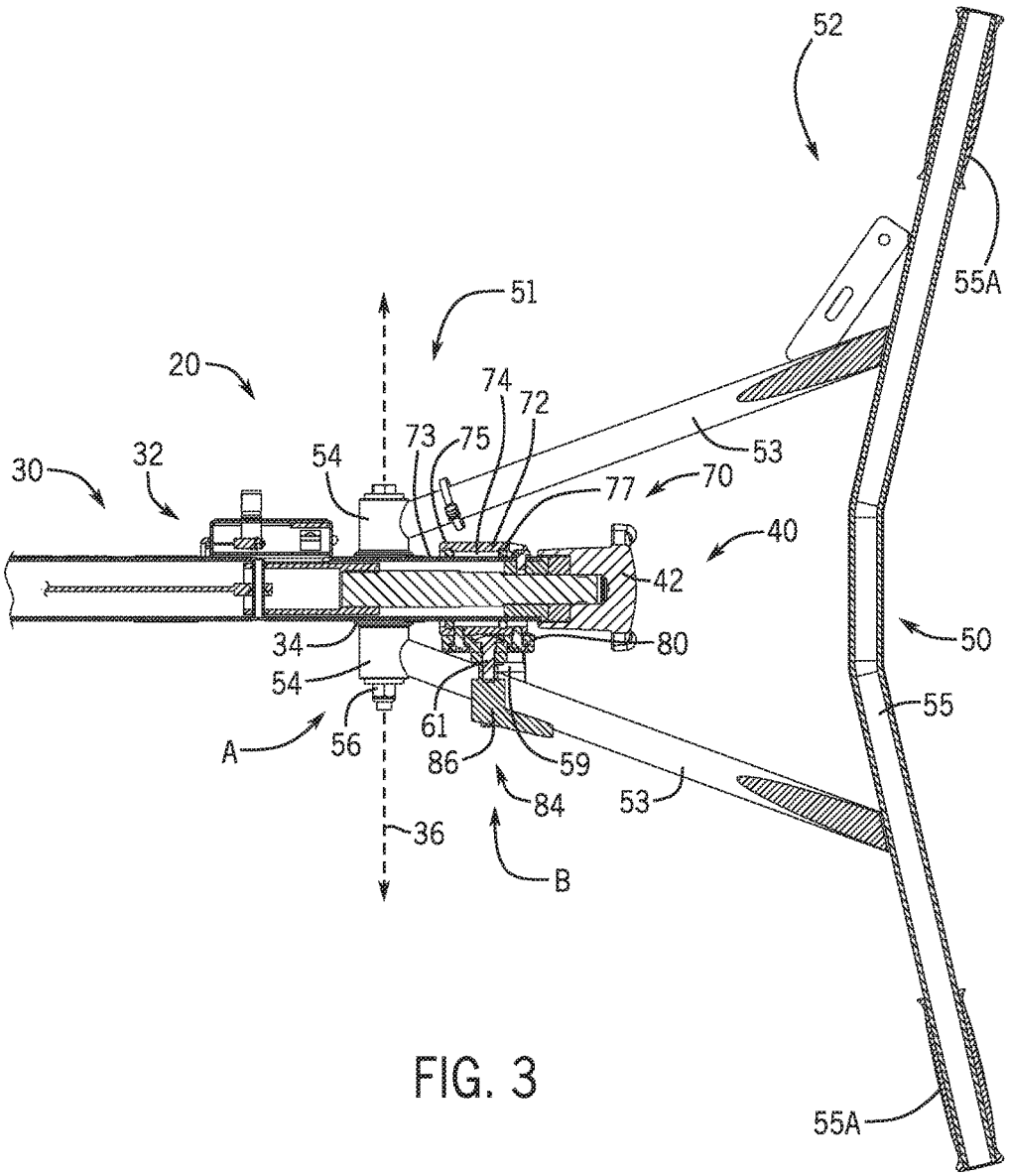
FIG. 3 is an enlarged cross section view of the handle assembly of FIG. 8 along line 1-1.

Referring to FIGS. 2-3, the handle assembly 20 includes a main handle 30 that is coupled to the gearbox 12 of the power tool 10. That is, the main handle 30 has a first end 31 (i.e. lower end) that is coupled to the gearbox 12 and a second end 32 (i.e. upper end) opposite the first end 31. The main handle 30 includes a handle bar bracket 34 that couples with a handle bar 50 (described herein) such that the handle bar 50 can pivot relative to the main handle 30. The size and/or shape of the handle bar bracket 34 can vary (e.g. a sleeve that is transverse to the main handle 30). The handle bar bracket 34 defines a pivot axis 36. One of ordinary skill in the art will recognize that the size and shape of the main handle 30 and/or the handle bar bracket 34 can vary (e.g. rectangular, oblong). In certain examples, the handle bar bracket 34 is positioned nearer the second end 32 than the first end 31. One having ordinary skill in the art will also recognize that the handle assembly 20 can be coupled to any component of the power tool 10.

The handle assembly 20 includes a pitch adjustment control assembly 40 that controls the pitch (or angle) of the trowel blades 16. The pitch adjustment control assembly 40 is coupled to the main handle 30 and includes a hand wheel 42 that can be operated by the operator to change the pitch of the trowel blades 16. Reference is made to the above-incorporated U.S. Patents for further description of example pitch adjustment control assemblies.

Referring to FIGS. 1-3 and 7, the handle assembly 20 includes a handle bar 50 that is coupled to the main handle 30 at a first vibration dampening point A and a second vibration dampening point B (described herein). The second vibration dampening point B is separate from the first vibration dampening point A, and the second vibration dampening point B is nearer the second end of the main handle 30 than the first vibration dampening point A. In certain examples, the second vibration dampening point B is positioned between the first end 51 of the handle bar 50 and the second end 52 of the handle bar 50. The present inventor has recognized that conventional handle assemblies often have multiple vibration dampening elements that are connected to each other with a rigid member such that the vibration dampening elements are connected and reliant on each other to dampen vibrations. As such, these conventional handle assemblies sacrifice some amount of vibration dampening and/or maneuverability (i.e. control or "feel") during operation. Through research and experimentation, the present inventor has discovered that it is beneficial to include multiple vibration dampening elements that can function independently of each other, i.e. each vibration dampening element can dampen vibrations independently of each other, yet each vibration dampening element relies or acts on each other to constrain or control movement of each other and a handle bar. As such, the handle assembly 20 of the present disclosure includes at least one isolation bushing 58 at the first vibration dampening point A and at least one resilient member 77 at the second vibration dampening point B which each dampen vibrations and control movement of each other and the handle bar such that the operational state of the handle assembly 20 can vary between an operational state of increased vibration dampening and an operational state of increased maneuverability of the power tool 10 (further described herein).

The handle bar 50 has a first end 51 and a second end 52 opposite the first end 51, and the first end 51 is pivotally coupled to the handle bar bracket 34 that is positioned at the first vibration dampening point A. The handle bar bracket 34 allows the operator to adjust the position and/or height of the handle bar 50 relative to the main handle 30 (described herein), and in certain examples, connection between the handle bar bracket 34 and the handle bar 50 is non-rigid. One having ordinary skill in the art will recognize that conventional handle assemblies often include rigid connections between the handle bar and the main handle. The handle bar 50 has two legs 53 that extend between the first end 51 and the second end 52. A handle 55 is coupled to the legs 53 at the second end 52 of the handle bar 50. The handle 55 includes at least one hand grip 55A that is grasped by the user during the operation of the power tool 10. Each leg 53 can include a mounting flange 54 that couples to the handle bar bracket 34 of the main handle 30.

The handle bar 50 includes a height adjustment bracket 59 coupled to one of the legs 53, and the height adjustment bracket 59 enables the operator to adjust the height of the handle bar 50 relative to the main handle 30 to a desired height. The height adjustment bracket 59 defines a hole 61 that receives a position adjustment assembly 84 (described herein). In certain examples, the hole 61 is defined by a leg 53.

The handle bar 50 includes two isolation bushings 58 (FIG. 2) that are configured to reduce, dampen, and/or isolate the amount and/or intensity of vibrations transmitted from the main handle 30 to the handle bar 50. The isolation bushings 58 are positioned at the first vibration dampening point A, and the isolation bushings 58 are sandwiched between the mounting flanges 54 and the handle bar bracket 34 with an elongated member 56 (e.g. bolt). The isolation bushings 58 are also configured to control movement of the handle bar 50 and a vibration dampening assembly 70 (described below) to thereby increase maneuverability (i.e. control or "feel") of the power tool 10.

The handle assembly 20 includes a vibration dampening assembly 70 positioned at the second vibration dampening point B and configured to couple the handle bar 50 to the main handle 30. The vibration dampening assembly 70 is configured to further dampen vibrations transmitted between the main handle 30 and the handle bar 50 and control movement of the handle bar 50 relative to the main handle 30. The vibration dampening assembly 70 is also configured to constrain or control compression and/or movement of the isolation bushings 58 which are positioned at the first vibration dampening point A (described herein). That is, as an operator applies a force to the handle bar 50 to move the power tool 10 the vibration dampening assembly 70 controls or constrains movement (e.g. rotation) of the handle bar 50 relative to the main handle 30 and compression of the isolation bushings 58 such that the maneuverability (i.e. control or "feel") of the power tool 10 increases and the vibration reduction or dampening of the vibration dampening assembly 70 and the isolation bushings 58 decreases. That is, the vibration dampening assembly 70, which is positioned at the second vibration dampening point B, and the isolation bushings 58, which are positioned at the first vibration dampening point A, controls movement of each other. Furthermore, the vibration dampening assembly 70 can be configured to control or limit movement (e.g. rotation) of the handle bar 50 relative to the main handle 30.

The vibration dampening assembly 70 includes a collar 72 that encircles the main handle 30. The collar 72 has an inner surface 73 and an outer surface 75 opposite the inner surface 73. The inner surface 73 is positioned nearer the main handle 30 than the outer surface 75, and the inner surface 73 defines at least one circumferential groove 74 (FIG. 2) that are each configured to receive a resilient member 77 (described herein). In other examples, the inner surface 73 is smooth and does not include grooves for receiving the resilient members 77. The size and/or shape of the collar 72 can vary (e.g. cylindrical, sleeve, rectangular). In certain examples, the size and/or shape of the collar 72 corresponds to the size and/or shape of the main handle 30. One having ordinary skill in the art will also recognize that in certain examples, the collar 72 and/or the resilient members 77 can move along the length of the main handle 30, i.e. the collar 72 and/or the resilient members 77 can move away from and/or toward the power tool 10.

The vibration dampening assembly 70 includes at least one resilient member 77 that is configured to dampen vibrations transmitted between the main handle 30 and the handle bar 50. The resilient member(s) 77 are positioned at the second vibration dampening point B. The resilient member(s) 77 are disposed or positioned (i.e. sandwiched) between the collar 72 and the main handle 30 and/or received in the circumferential groove(s) 74. The number, size and/or shape of the resilient member(s) 77 can vary, and in the example vibration dampening assembly 70 depicted in FIG. 2, two annular resilient members 77 are included (e.g. an O-ring). The resilient member(s) 77 can be made of any suitable material (e.g. rubber, plastic).

In operation, the resilient member(s) 77 positioned at the second vibration dampening point B are configured to constrain or control movement of the isolation bushing(s) 58 that are positioned at the first vibration dampening point A (described above). During a majority of the time the power tool 10 is in operation, the vibration resilient member(s) 77 and the isolation bushings 58 greatly reduce or dampen vibrations transmitted due to the elastic properties of the resilient member(s) 77 and the isolation bushings 58. However, when a force H (see FIGS. 5-6) is applied to the handle assembly 20 (e.g. the force H is applied by the operator to move the power tool 10) the position and/or function of the resilient member(s) 77 and the isolation bushings 58 change such that vibration dampening by the resilient member(s) 77 and the isolation bushings 58 is sacrificed in favor of increased maneuverability (i.e. control and "feel") of the power tool 10, as will be described below. That is, the resilient member(s) 77 and/or the isolation bushings 58 move into and between a state or position of lesser compression and a state or position of greater compression based on forces acting on the handle assembly 20 (e.g. as additional or more compressive forces act on the resilient member(s) 77, the resilient member(s) 77 move from a state of lesser compression to a state of greater compression).

Figure 4:
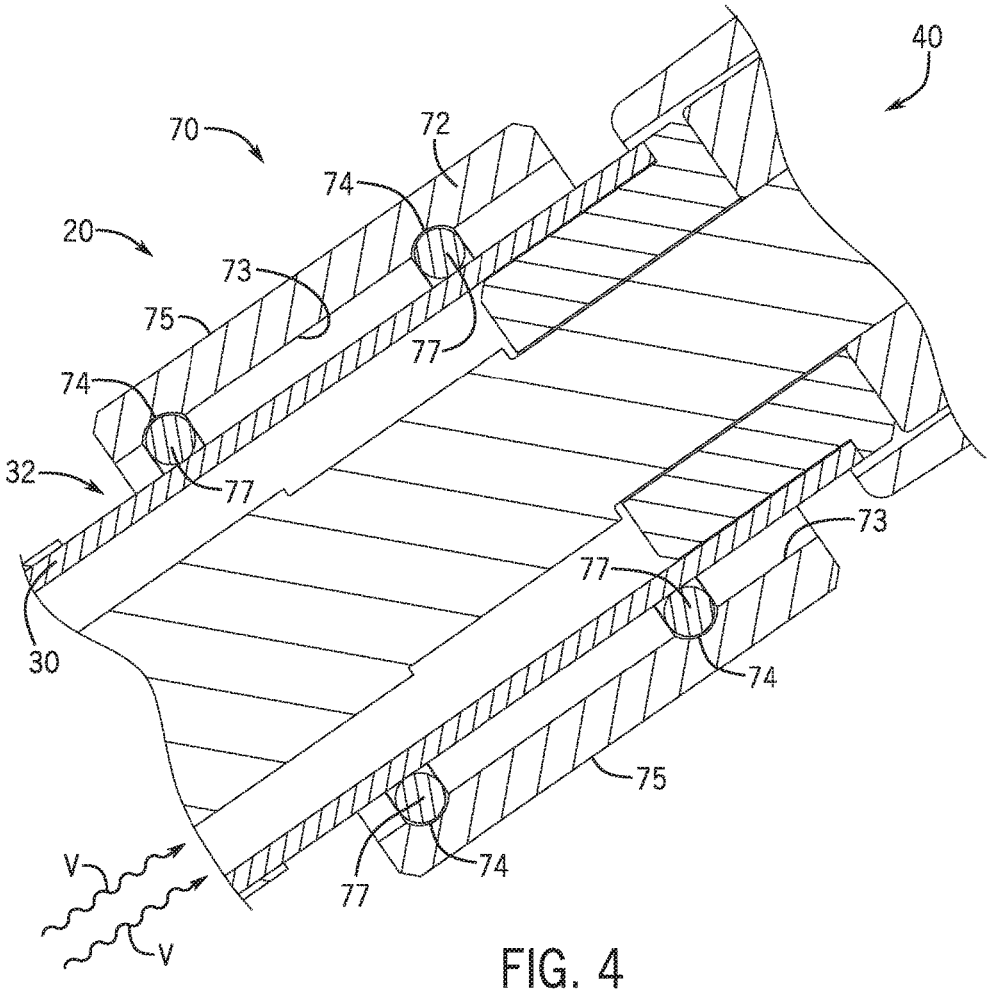
FIG. 4 is a cross section view of the handle assembly of FIG. 8 within line 4-4 and resilient members in a state of lesser compression.

Referring to FIG. 4, the resilient member(s) 77, which are positioned at the second vibration dampening point B, are in a state of lesser compression such that the resilient member (s) 77 reduce or dampen a large amount of vibrations (i.e. the resilient member(s) 77 greatly reduce or dampen vibrations when the resilient member(s) 77 are in a state of lesser compression). Similarly, the isolation bushings 58 (see FIG. 2), which are positioned at the first vibration dampening point A, are in a state of lesser compression and configured to reduce or dampen a large amount of vibrations.

Figure 5:
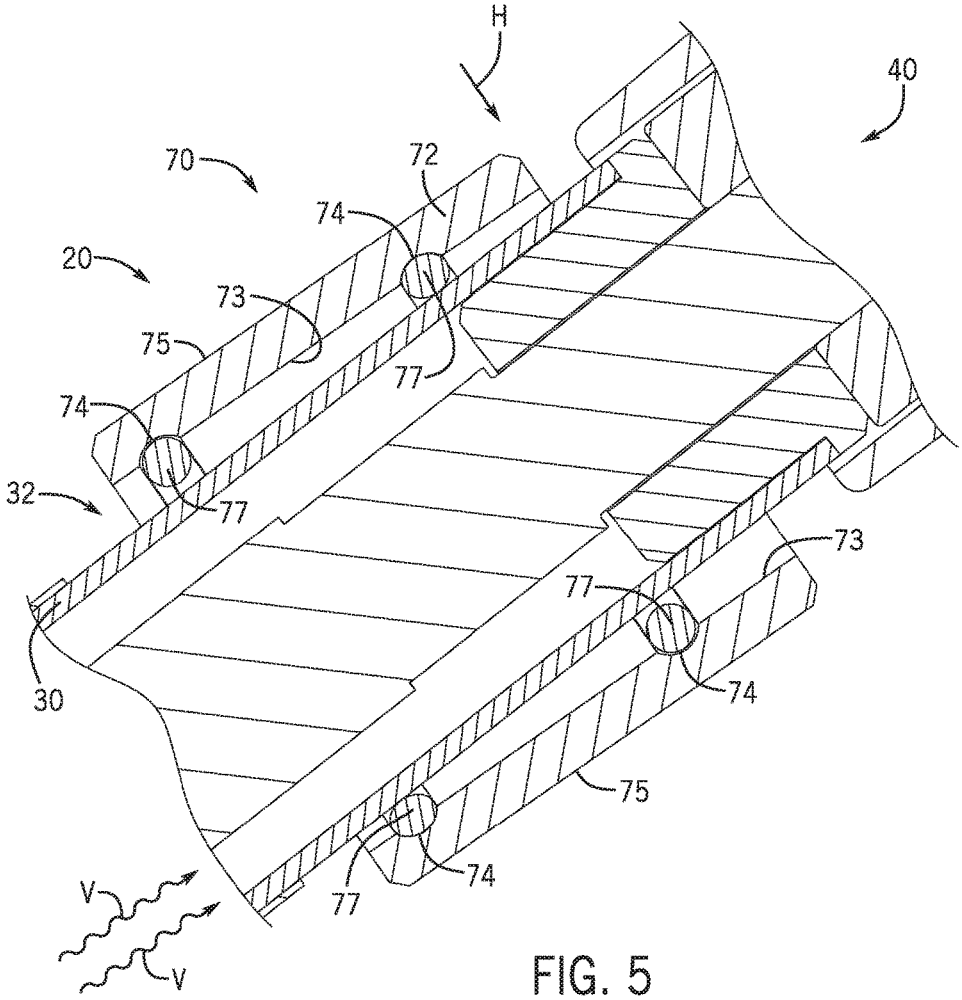
FIG. 5 is a cross section view of the handle assembly of FIG. 8 within line 4-4 and the resilient members in a state of greater compression.
Figure 6:
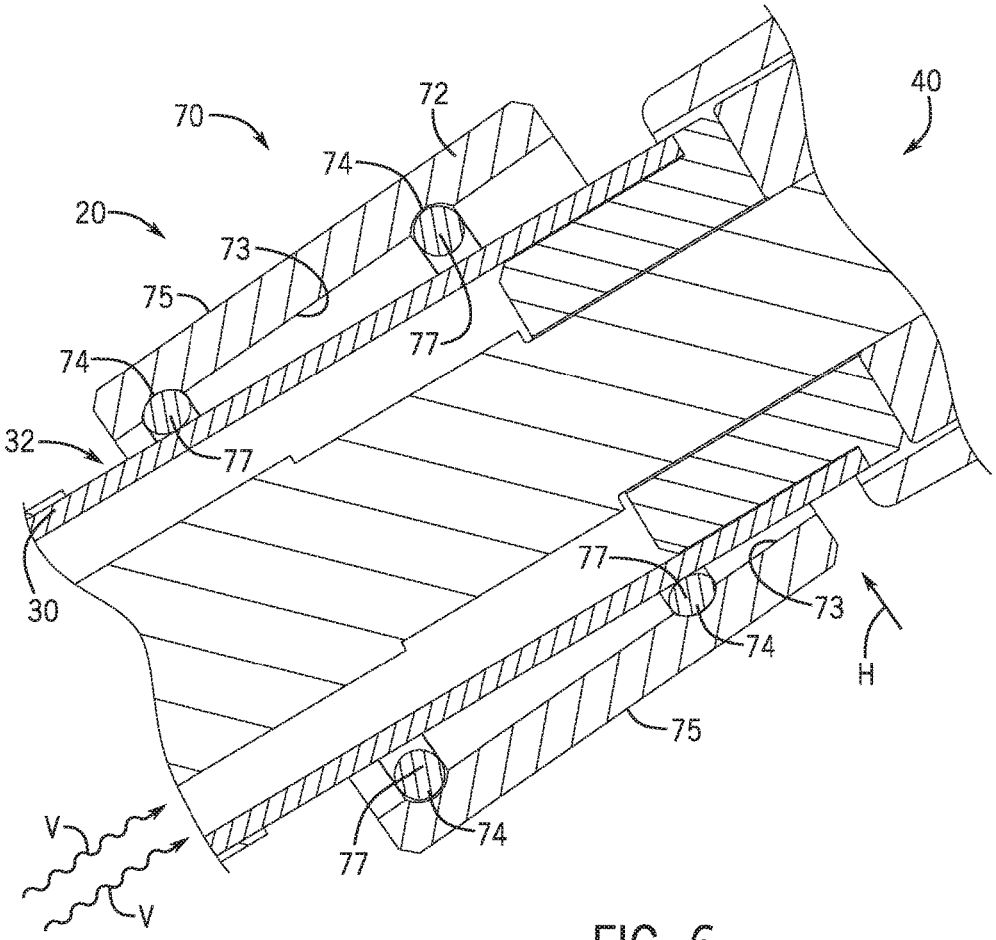
FIG. 6 is a cross section view of the handle assembly of FIG. 8 within line 4-4 and the resilient members in a state of greater compression.

Referring to FIGS. 5-6, a force H is depicted being applied to the handle assembly 20 such that the resilient member(s) 77 compress into circumferential grooves 74 (i.e. the resilient member(s) 77 move to a state of greater compression) as the handle bar 50 slightly moves relative to the main handle 30. As the resilient member(s) 77 progressively compress into the circumferential grooves 74, vibration transmission through the resilient member(s) 77 progressively decreases and the maneuverability of the power tool 10 progressively increases (i.e. the operator has increased control or "feel" of the power trowel). Movement of the handle bar 50 relative to the main handle 30 also causes the isolation bushings 58, which are positioned at the first vibration dampening point A, to compress (i.e. move to a state of greater compression) such that more vibrations transmit through the isolation bushings 58 when compared to isolation bushings 58 in a state of lesser compression. The result of the resilient member(s) 77 being progressively compressed into the circumferential groove 74 and/or the isolation bushings 58 being progressively compressed is that vibration reduction and dampening is reduced or sacrificed in favor of increasing maneuverability (i.e. control and "feel") of the power tool 10.

When the force H no longer acts on the handle assembly 20 (i.e. the operator stops applying the force H to the handle bar 50), the resilient member(s) 77 positioned at the second vibration dampening point B move back to the state of lesser compression (FIG. 4) and the isolation bushings 58 positioned at the first vibration dampening point A also move to the state of lesser compression. As such, the resilient member(s) 77 and the isolation bushings 58 again reduce or dampen large amount of vibrations. The alternating states of compression of the resilient member(s) 77 and/or isolation bushings 58 allows the handle assembly 20 of the present disclosure to outperform conventional handle assemblies that operate in fixed states or biases which typically favor control at the expense of larger vibration reduction or isolation. For example, when the resilient member(s) 77 are in the state of lesser compression (FIG. 4), the resilient member(s) 77 are in a state that favors facilitating a large reduction or isolation of vibrations transmitted. Alternatively, when the resilient member(s) 77 are in the state of greater compression (FIGS. 5-6), the resilient member(s) 77 progressively move to a state of enhanced maneuverability (i.e. control and "feel"). The alternating operational states of the resilient member(s) 77 allows the handle assembly 20 of the present disclosure to outperform the fixed states or biases of conventional handle assemblies which always favor control at the expense of larger vibration reduction or isolation.

The vibration dampening assembly 70 is effective at reducing or dampening vibrations having directional components along a vertical axis V, a horizontal axis H (forward/backward axis), a lateral axis L (side-to-side axis), and/or combinations thereof (FIG. 1), while the isolation bushings 58 primarily reduce or dampen vibrations having directional components along the vertical axis V, a horizontal axis H, and/or combinations thereof (FIG. 1.). The vibration dampening assembly 70 and the isolation bushings 58 complement each other in terms of reducing or dampening a wide range of vibrations with various directional components. The resilient member 77 and/or the isolation bushings 58 can be formed from materials with lower durometer values when compared to the materials used in conventional vibration dampening assemblies and handle assemblies.

The vibration dampening assembly 70 includes a bracket 80 on the outer surface 75 of the collar 72. The bracket 80 defines a slot 83 that is configured to receive the position adjustment assembly 84 (described herein). The shape and/or size of the slot 83 can vary (e.g. circular, radial, curved, straight, rectangular). In certain examples the slot 83 is curved such that the slot 83 continuously aligns with a hole 61 (described further herein) defined in the handle bar 50 as pivots about the pivot axis 36.

Referring to FIGS. 7-10, the vibration dampening assembly 70 includes a position adjustment assembly 84 that is configured to engage the bracket 80 and the handle bar 50 to thereby secure the handle bar 50 in the desired position relative to the main handle 30. That is, the position adjustment assembly 84 is received in the slot 83 defined by the bracket 80 and a hole 61 (FIG. 2) defined by the handle bar 50 such that the position adjustment assembly 84 sets the position of the handle bar 50 relative to the main handle 30 at the desired position. During operation, the handle bar 50 can be pivoted slightly and allows for some amount of movement relative to the main handle 30 that is controlled by the resilient member(s) 77 at the second vibration dampening point B. The position adjustment assembly 84 can include any suitable components including a pin, carriage bolt, washer, lever 86, and the like.

Figure 7:
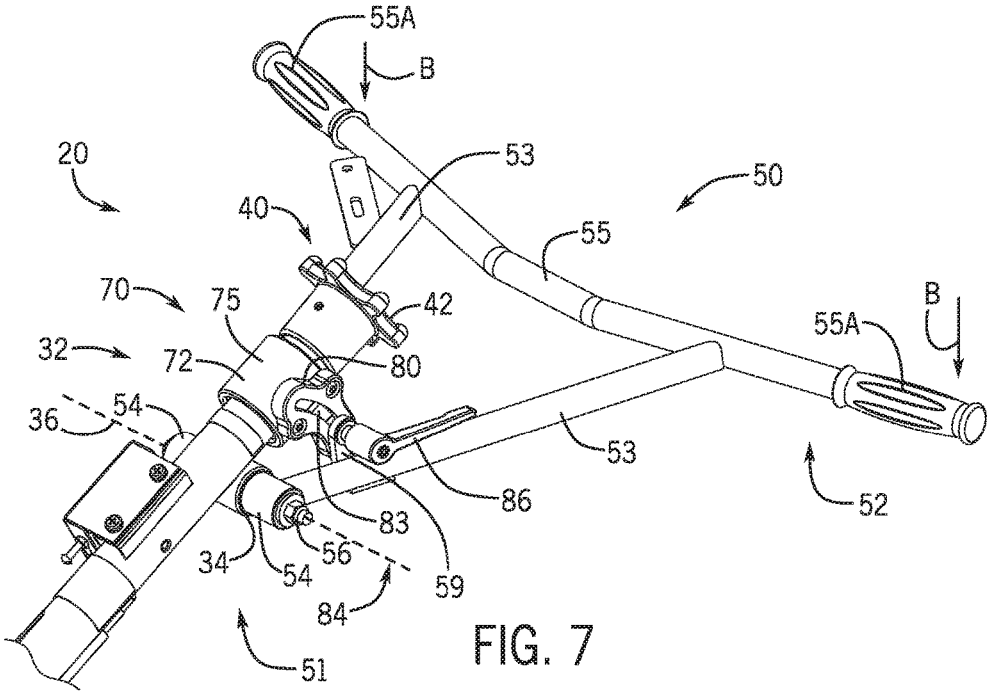
FIG. 7 is a perspective view of an example handle assembly with a handle bar in a first position.
Figure 8:
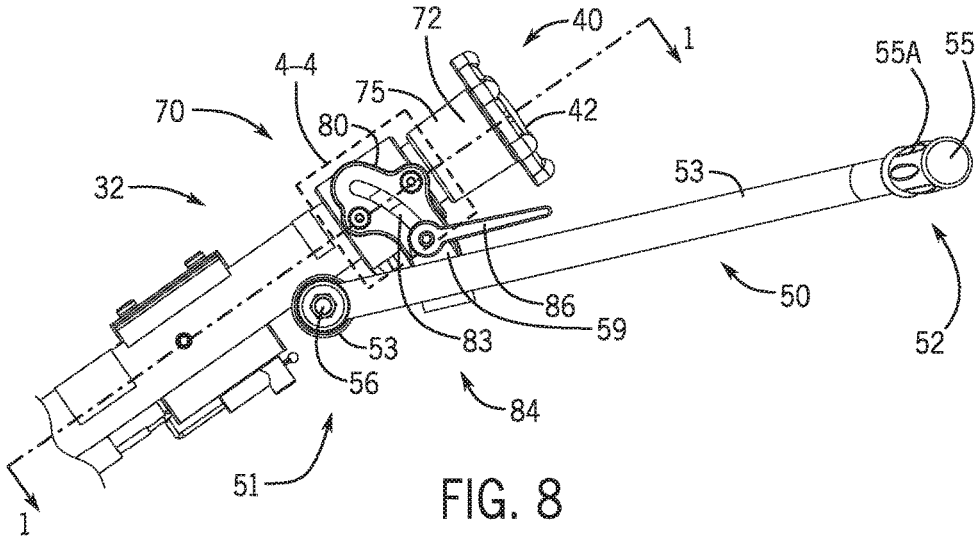
FIG. 8 is a side view of the handle assembly of FIG. 7.
Figure 9:
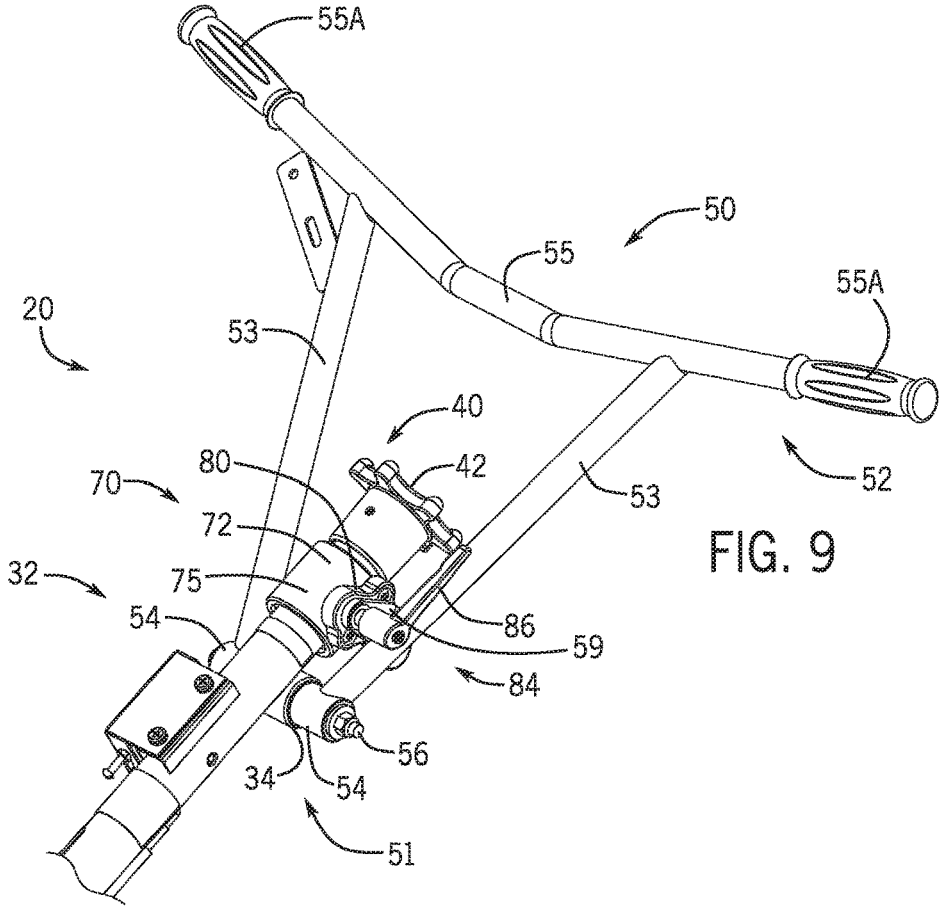
FIG. 9 is a perspective view of an example handle assembly with the handle bar in a second position.
Figure 10:
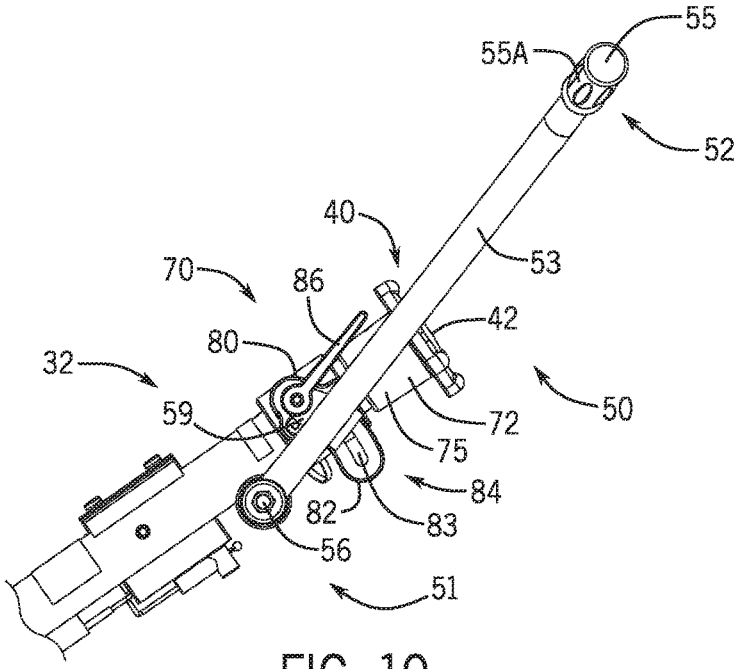
FIG. 10 is a side view of the handle assembly of FIG. 9.

To select the desired position, the operator moves the lever 86 to a locked position which causes the position adjustment assembly 84 to force the height adjustment bracket 59 into frictional contact with the bracket 80 (i.e. a surface of the bracket 80 contacts or abuts the height adjustment bracket 59) such that the handle bar 50 is prevented from pivoting (i.e. the height adjustment bracket 59 and the bracket 80 do not move relative to each other). When the operator moves the lever 86 to an unlocked position (not shown), the handle bar 50 can freely pivot about the pivot axis 36 to the desired position. FIGS. 7-8 depict the handle bar 50 in a first desired position (i.e. a base position). FIGS. 9-10 depict the handle bar 50 in a second desired position (i.e. an upper position). One of ordinary skill in the art will recognize that the desired position can be any position including the base position (FIG. 8), the upper position (FIG. 10) and any position there between. The position adjustment assembly 84 can be any suitable member or assembly (e.g. a treaded bolt with a treaded lever and treaded bolt.

The handle assembly 20 is effective at reducing and/or dampening the broad range vibrations transmitted to the operator from the power tool 10. The handle assembly 20 of the present disclosure allows the handle bar 50 to "float" relative to the main handle 30 such as to isolate or dampen the broad range vibrations while still allowing the operator to maintain a level of "feel" while operating the power tool 10. Often when the operator lacks "feel" with the power tool 10 and/or the surface being finished by the finishing machine, the operator is unable to determine the current state of the surface (i.e. the operator is unable to "feel" how the power tool 10 is reacting to the surface being worked and/or unable to "feel" the current state (unfinished or finished) of the surface being worked). In particular, the collar 72 and resilient members 77 of the vibration dampening assembly 70 of the present disclosure are able to isolate or dampen the broad range vibrations while providing a limit or constraint on the "float" or "play" of the handle bar 50 as the operator maneuvers the power tool 10. In contrast with the handle assembly 20 of the present disclosure, currently manufactured finishing machines with vibration isolation assemblies sacrifice a significant amount of isolation reduction, due to much stiffer shock absorbing elements, in order to maintain operator control and/or "feel" of the power tool 10.

The handle assembly 20 and/or the vibration dampening assembly 70, can be modified to account for power tools 10 with different engine sizes, main handle sizes, and/or trowel blades. In particular, the size of the collar 72, the durometer of the resilient members 77, the thickness of the resilient members 77, and the number of resilient members 77 can be modified based on the specific application of the vibration dampening assembly 70. These are merely exemplary changes of the vibration dampening assembly 70 and other changes and/or modifications to the components described herein may be made based on the power tool 10 utilized.

In one example experiment, two power trowels (power trowel No. 1 and power trowel No. 2 (note each power trowel is manufactured by a different manufacturer)) were tested to examine the amount of vibrations transmitted to the handle bar of each power trowel and to determine a corresponding time to reach an exposure limit valve (ELV). The time to reach the ELV is related to industry or government health and safety standards and the length of time an operator can operate a machine before reaching a vibration exposure limit value (an example ELV is 5.0 $m/s^2$ or 400 exposure points (wherein exposure points are based on vibration magnitude and exposure time)). For instance, based on observed vibration magnitudes produced by a machine, an operator may only be able to operate a machine for 4 hours and 40 minutes before exceeding the ELV. Reference is made publically available information and descriptions of the ELV and example Hand-Arm vibration standards from The Health and Safety Executive (http://www.hse.gov.uk/vibration/).

For purposes of this example experiment, both power trowels (power trowel No. 1 and power trowel No. 2) were fitted with the same motor manufacture and specification number, and both power trowels were operated on the same durable, smooth surface, e.g. a steel plate, such that the surface on which the power trowels were operated on for testing was constant. Power trowel No. 1 was fitted with and without the handle assembly 20 described above, and power trowel No. 2 was fitted with and without a prior art vibration isolation assembly that is sold with power trowel No. 2. The resulting vibration magnitudes, measured in $m/s^2$, were recorded and entered into a publically available spreadsheet tool used to calculate the time to reach ELV based on the observed vibration magnitudes. The values of the time to reach ELV based on the observed vibration magnitudes are shown in TABLE 1.

TABLE 1

| Power Trowel Configuration | Handle Type | Time to Reach ELV (Vibration Magnitudes ($m/s^2$)) |
|---|---|---|
| Power Trowel No. 1 | without handle assembly 20 | 06 hours and 11 minutes (5.69 $m/s^2$) |
| Power Trowel No. 1 | with handle assembly 20 | 21 hours and 22 minutes (3.06 $m/s^2$) |
| Power Trowel No. 2 | without prior art vibration isolation assembly | 06 hours and 37 minutes (5.50 $m/s^2$) |
| Power Trowel No. 2 | with prior art vibration isolation assembly | 07 hours and 20 minutes (5.22 $m/s^2$) |

As shown in TABLE 1, the time to reach ELV for each power trowel without vibration isolation assemblies (i.e. power trowel No. 1 without the handle assembly 20 and power trowel No. 2 without the prior art vibration isolation assembly) were similar to each other (6 hours and 11 minutes compared to 6 hours and 37 minutes). When power trowel No. 2 was fitted with the prior art vibration isolation assembly, the time to reach ELV increased slightly (time to reach ELV increased 47 minutes or 10.83%). In contrast, when power trowel No. 1 was fitted with the handle assembly 20, the time to reach ELV increased significantly (time to reach ELV increased 911 minutes or 245.55%).

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A handle assembly for a concrete finishing machine, the handle assembly comprising:

a main handle having a first end configured to couple to the concrete finishing machine;

a handle bar having a first end coupled to the main handle at a first vibration dampening point and a second end opposite the first end, the handle bar has an isolation bushing positioned at the first dampening point and configured to dampen vibrations transmitted between the main handle and the handle bar; and a vibration dampening assembly that couples the handle bar to the main handle at a second vibration dampening point, the vibration dampening assembly is configured to further dampen vibrations transmitted between the main handle and the handle bar; wherein the vibration dampening assembly includes a collar that encircles the main handle and a resilient member positioned between the collar and the main handle; and wherein the resilient member is configured to be compressed between the main handle and the collar such that dampening of vibrations and maneuverability of the concrete finishing machine varies as the resilient member is compressed.

2. The handle assembly according to claim 1, wherein the maneuverability of the concrete finishing machine progressively increases as the resilient member is compressed.

3. The handle assembly according to claim 2, wherein the dampening of vibrations progressively increases as compressive forces acting on the resilient member decrease.

4. The handle assembly of claim 3, wherein the isolation bushing at the first vibration dampening point controls movement of the vibration dampening assembly at the second vibration dampening point.

5. The handle assembly according to claim 4, wherein the second vibration dampening point is positioned between the first end of the handle bar and the second end of the handle bar.

6. The handle assembly according to claim 4, wherein the resilient member is annular and disposed on the main handle such that the resilient member encircles the main handle.

7. The handle assembly according to claim 6, wherein the collar has an inner surface that defines a circumferential groove into which the resilient member compresses.

8. The handle assembly according to claim 7, wherein the resilient member is configured to move into and between a state of lesser compression in which the resilient member is disposed between the main handle and the collar and a state of greater compression in which the resilient member is compressed into the circumferential groove.

9. The handle assembly according to claim 8, wherein the resilient member in the state of lesser compression is configured to dampen more vibrations than when the resilient member is in the state of greater compression.

10. The handle assembly according to claim 3, wherein the main handle defines a pivot axis at the first vibration dampening point; and wherein the first end of the handle bar is pivotally coupled to the main handle at the pivot axis such that the handle bar can be pivoted to a desired position relative to the main handle yet allow for some amount of movement that is controlled by the resilient member at the second vibration dampening point.

11. The handle assembly according to claim 10, wherein the vibration dampening assembly includes a bracket and a position adjustment assembly; and wherein the position adjustment assembly is configured to engage the bracket and the handle bar to thereby secure the handle bar in the desired position.

12. The handle assembly according to claim 11, wherein the bracket defines a curved slot and the handle defines a hole that continuously aligns with the curved slot as the handle bar pivots about the pivot axis.

13. A handle assembly for a concrete finishing machine, the handle assembly comprising:

a main handle having a first end configured to couple to the concrete finishing machine;

a handle bar having a first end coupled to the main handle at a first vibration dampening point and a second end opposite the first end, the handle bar has an isolation bushing positioned at the first vibration dampening point and configured to dampen vibrations transmitted between the main handle and the handle bar; and a vibration dampening assembly that couples the handle bar to the main handle at a second vibration dampening point and is configured to further dampen vibrations transmitted between the main handle and the handle bar;

wherein the vibration dampening assembly includes a collar that encircles the main handle and a pair of annular resilient members positioned between the collar and the main handle;

wherein the collar has an inner surface that defines a pair of circumferential grooves the receive the annular resilient members; and wherein the resilient members are configured to be compressed into the circumferential grooves such that dampening of vibrations and maneuverability of the concrete finishing machine varies as the resilient members are compressed.

14. The handle assembly according to claim 13, wherein the maneuverability of the concrete finishing machine progressively increases as the resilient members are compressed into the circumferential grooves; and wherein the dampening of vibrations progressively increases as compressive forces acting on the resilient members decrease.

15. The handle assembly of claim 13, wherein the isolation bushing positioned at the first vibration dampening point controls movement of the vibration dampening assembly positioned at the second vibration dampening point.

16. The handle assembly according to claim 15, wherein the second vibration dampening point is separate from the first vibration dampening point; and wherein the second vibration dampening point is positioned between the first end of the handle bar and the second end of the handle bar.

17. The handle assembly according to claim 16, wherein the resilient members are configured to move into and between a state of lesser compression in which the resilient members are disposed between the main handle and the collar and a state of greater compression in which the resilient members are compressed into the circumferential groove; and wherein the resilient member in the state of lesser compression is configured to dampen more vibrations than when the resilient member is in the state of greater compression.

18. The handle assembly according to claim 17, wherein the main handle defines a pivot axis at the first vibration dampening point;

wherein the first end of the handle bar is pivotally coupled to the main handle at the pivot axis such that the handle bar can be pivoted to a desired position relative to the main handle yet retain some amount of movement that is controlled by resilient members at the second vibration dampening point;

wherein the vibration dampening assembly includes a bracket and a position adjustment assembly, the position adjustment assembly is configured to engage the bracket and the handle bar to thereby secure the handle bar in the desired position; and wherein the bracket defines a curved slot and the handle defines a hole that continuously aligns with the curved slot as the handle bar pivots about the pivot axis.

19. A motorized trowel for finishing a surface, the motorized trowel comprising:

a guard ring;

a motor coupled to the guard ring;

a plurality of trowel blades operably coupled to the motor and configured to rotate when the motor is activated;

a main handle having a first end configured to couple to the motorized trowel;

a handle bar having a first end coupled to the main handle at a first vibration dampening point and a second end opposite the first end, the handle bar has an isolation bushing positioned at the first vibration dampening point and configured to dampen vibrations transmitted between the main handle and the handle bar; and a vibration dampening assembly that couples the handle bar to the main handle at a second vibration dampening point and is configured to further dampen vibrations transmitted between the main handle and the handle bar;

wherein the vibration dampening assembly includes a collar that encircles the main handle and a pair of annular resilient member positioned between the collar and the main handle;

wherein the collar has an inner surface that defines a pair of circumferential grooves the receive the resilient members; and wherein the resilient members are configured to be compressed into the circumferential grooves such that maneuverability of the motorized trowel improves as the resilient members are compressed.

20. The motorized trowel of claim 19, wherein the vibration dampening assembly includes a bracket and a position adjustment assembly; wherein the position adjustment assembly is configured to engage the bracket and the handle bar to thereby secure the handle bar in the desired position; and wherein the bracket defines a curved slot and the handle defines a hole that continuously aligns with the curved slot as the handle bar pivots about the pivot axis.

* * * * *